US009013376B2

(12) United States Patent
Nozawa

(10) Patent No.: US 9,013,376 B2
(45) Date of Patent: Apr. 21, 2015

(54) LIGHT EMITTING DEVICE, METHOD OF DRIVING PIXEL CIRCUIT, AND DRIVING CIRCUIT

(71) Applicant: Seiko Epson Corporation, Tokyo (JP)

(72) Inventor: Toshiyuki Nozawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/748,272

(22) Filed: Jan. 23, 2013

(65) Prior Publication Data

US 2013/0134896 A1 May 30, 2013

Related U.S. Application Data

(62) Division of application No. 11/765,206, filed on Jun. 19, 2007, now abandoned.

(30) Foreign Application Priority Data

Jul. 3, 2006 (JP) ..... 2006-183054

(51) Int. Cl.
*G09G 3/30* (2006.01)
*H05B 37/02* (2006.01)
*G09G 3/32* (2006.01)

(52) U.S. Cl.
CPC ..... *H05B 37/02* (2013.01); *G09G 3/3233* (2013.01); *G09G 3/3291* (2013.01); *G09G 2300/0819* (2013.01); *G09G 2300/0842* (2013.01); *G09G 2300/0852* (2013.01); *G09G 2300/0861* (2013.01); *G09G 2320/043* (2013.01)

(58) Field of Classification Search
CPC ..... G09G 3/30
USPC ..... 345/46, 76, 77, 81–83, 92, 204–212; 315/169.3
See application file for complete search history.

(56) References Cited

U.S. PATENT DOCUMENTS 6,229,506 B1 5/2001 Dawson et al.
7,184,006 B2 * 2/2007 Kim ..... 345/76

(Continued)

FOREIGN PATENT DOCUMENTS

CN 1574385 A 2/2005
JP A-2003-022049 1/2003

(Continued)

OTHER PUBLICATIONS

Jun. 7, 2010 Office Action issued in U.S. Appl. No. 11/765,206.

(Continued)

*Primary Examiner* — Pegeman Karimi
(74) *Attorney, Agent, or Firm* — Oliff PLC

(57) ABSTRACT

A method of driving a pixel circuit is provided. The pixel circuit includes a light emitting element that emits light by receiving a driving current, a driving transistor that generates the driving current, and a light-emission control transistor of the same conductivity type as that of the driving transistor, the light-emission control transistor being arranged on a path through which the driving current flows from the driving transistor to the light emitting element. The method includes setting the gate potential of the light-emission control transistor so that the light-emission control transistor is turned on in the saturation region for a light emitting period during which the light emitting element is allowed to emit light.

8 Claims, 13 Drawing Sheets

(56) References Cited

U.S. PATENT DOCUMENTS

| | | | | |
|---|---|---|---|---|
| 7,710,366 | B2 | 5/2010 | Lee et al. | |
| 7,742,024 | B2 | 6/2010 | Fukumoto et al. | |
| 2001/0019327 | A1* | 9/2001 | Kim et al. | 345/204 |
| 2002/0113760 | A1 | 8/2002 | Kimura | |
| 2004/0174349 | A1 | 9/2004 | Libsch et al. | |
| 2004/0196239 | A1* | 10/2004 | Kwon | 345/92 |
| 2004/0256997 | A1 | 12/2004 | Fukumoto et al. | |
| 2005/0007316 | A1* | 1/2005 | Akimoto et al. | 345/76 |
| 2005/0051776 | A1 | 3/2005 | Miyagi et al. | |
| 2005/0057459 | A1* | 3/2005 | Miyazawa | 345/76 |
| 2005/0206590 | A1* | 9/2005 | Sasaki et al. | 345/76 |
| 2006/0015272 | A1* | 1/2006 | Giraldo et al. | 702/58 |
| 2006/0022912 | A1* | 2/2006 | Park et al. | 345/76 |
| 2006/0038758 | A1 | 2/2006 | Routley et al. | |
| 2006/0152459 | A1 | 7/2006 | Shin | |
| 2006/0158398 | A1 | 7/2006 | Akimoto et al. | |

FOREIGN PATENT DOCUMENTS

| | | |
|---|---|---|
| JP | A-2006-195307 | 7/2006 |
| JP | A-2006-276706 | 10/2006 |

OTHER PUBLICATIONS

Oct. 28, 2010 Final Office Action issued in U.S. Appl. No. 11/765,206.

Apr. 29, 2011 Office Action issued in U.S. Appl. No. 11/765,206.

Nov. 8, 2011 Final Office Action issued in U.S. Appl. No. 11/765,206.

Jan. 17, 2012 Advisory Action issued in U.S. Appl. No. 11/765,206.

Feb. 3, 2012 Office Action issued in U.S. Appl. No. 11/765,206.

Oct. 23, 2012 Final Office Action issued in U.S. Appl. No. 11/765,206.

* cited by examiner

LIGHT EMITTING DEVICE, METHOD OF DRIVING PIXEL CIRCUIT, AND DRIVING CIRCUIT

This application is a U.S. Divisional of U.S. application Ser. No. 11/765,206 filed Jun. 19, 2007, which claims the benefit of priority to Japanese Patent Application No. 2006-183054 filed Jul. 3, 2006, the contents of which are incorporated herein by reference.

BACKGROUND

1. Technical Field

The present invention relates to a technique of controlling a light emitting element, such as an organic light emitting diode.

2. Related Art

Light emitting devices using active elements, such as thin film transistors, for controlling a current (hereinafter, referred to as a driving current) supplied to a light emitting element have been proposed. FIG. 18 shows the arrangement of a driving transistor $T_{DR}$ and a light-emission control transistor $T_{EL}$ on a path through which a driving current $I_{DR}$ flows, the arrangement being disclosed in, for example, U.S. Pat. No. 6,229,506 and JP-A-2003-22049. The driving transistor $T_{DR}$ generates the driving current $I_{DR}$ according to the gate potential. The light-emission control transistor $T_{EL}$, arranged between the driving transistor $T_{DR}$ and a light emitting element E, switches to the ON state for a predetermined period (hereinafter, referred to as a light emitting period), thus permitting supply of the driving current $I_{DR}$ into the light emitting element E.

Although the operating points of most of the driving transistors $T_{DR}$ are set so as to lie within a saturation region, the driving current $I_{DR}$ is changed in accordance with the drain-source voltage of the corresponding driving transistor $T_{DR}$ by the channel length modulation effect. On the other hand, the electrical characteristics of each light emitting element E include errors (e.g., an error from a design value and a variation between elements). For example, the relationship between the driving current $I_{DR}$ and the voltage across the light emitting element E may differ from element to element. The difference in voltage across the light emitting element E between the elements leads to a fluctuation in drain-source voltage between the driving transistors $T_{DR}$. Unfortunately, even when the gate potentials of the respective driving transistors $T_{DR}$ are set to the same value, the driving current $I_{DR}$ supplied to each light emitting element E (therefore, the light intensity thereof) differs from element to element in accordance with its electrical characteristics.

SUMMARY

An advantage of some aspects of the invention is to reduce the influence of the electrical characteristics of a light emitting element on a driving current.

According to an aspect of this invention, there is provided a method of driving a pixel circuit including a light emitting element that emits light by receiving a driving current, a driving transistor that generates the driving current, and a light-emission control transistor of the same conductivity type as that of the driving transistor, the light-emission control transistor being arranged on a path through which the driving current flows from the driving transistor to the light emitting element. The method includes setting the gate potential of the light-emission control transistor so that the light-emission control transistor is turned on in the saturation region for a light emitting period during which the light emitting element is allowed to emit light.

In accordance with this aspect of the invention, since the light-emission control transistor operates in the saturation region for the light emitting period, even when the potential of the node between the light-emission control transistor and the light emitting element changes in accordance with the electrical characteristics of the light emitting element, a change of the potential of the node between the light-emission control transistor and the driving transistor (the drain potential of the driving transistor) is suppressed. Therefore, the influence of the electrical characteristics of the light emitting element on the driving current can be reduced.

In an embodiment (e.g., a first embodiment which will be described below), preferably, the driving transistor and the light-emission control transistor are of P-channel type, the driving transistor is arranged between a first power supply line (e.g., a power supply line $L_1$ in FIG. 3) and the light-emission control transistor, the light emitting element is arranged between the light-emission control transistor and a second power supply line (e.g., a power supply line $L_2$ in FIG. 3). In this case, when let $-V_{EL}$ ($-V_{EL}<0$) be the potential of the second power supply line with reference to the potential of the first power supply line, let $V_{EL_MAX}$ ($V_{EL_MAX}<0$) be the voltage across the light emitting element with a maximum voltage drop with reference to the potential of the electrode thereof on the light-emission control transistor side, let $V_{T2}$ ($V_{T2}<0$) be the threshold voltage of the light-emission control transistor, and let $V_{G_ON}$ be the gate potential of the light-emission control transistor, the gate potential of the light-emission control transistor for the light emitting period is set so as to satisfy the following relation: $V_{G_ON}>-V_{EL}-V_{EL_MAX}+V_{T2}$. In this case, the light-emission control transistor can be reliably allowed to operate in the saturation region.

Preferably, when let $V_{DATA_MAX}$ ($V_{DATA_MAX}<0$) be the gate-source voltage of the driving transistor of which the driving current reaches its maximum value and let $V_{T1}$ ($V_{T1}<0$) be the threshold voltage of the driving transistor, the gate potential of the light-emission control transistor for the light emitting period is set so as to satisfy the following relation: $V_{G_ON}<V_{DATA_MAX}-V_{T1}+V_{T2}$. In this case, since the driving transistor operates in the saturation region, the driving transistor can be used as a stable constant current source.

In another embodiment (e.g., a second embodiment which will be described below), the driving transistor and the light-emission control transistor may be of N-channel type, the light emitting element may be arranged between a first power supply line (e.g., a power supply line $L_1$ in FIG. 8) and the light-emission control transistor, the driving transistor may be arranged between the light-emission control transistor and a second power supply line (e.g., a power supply line $L_2$ in FIG. 8). Preferably, when let $V_{EL}$ ($V_{EL}>0$) be the potential of the first power supply line with reference to the potential of the second power supply line, let $V_{EL_MAX}$ ($V_{EL_MAX}>0$) be the voltage across the light emitting element with a maximum voltage drop with reference to the potential of the electrode thereof on the light-emission control transistor side, let $V_{T2}$ ($V_{T2}>0$) be the threshold voltage of the light-emission control transistor, and let $V_{G_ON}$ be the gate potential of the light-emission control transistor, the gate potential of the light-emission control transistor for the light emitting period is set so as to satisfy the following relation: $V_{G_ON}<V_{EL}-V_{EL_MAX}+V_{T2}$. In this case, the light-emission control transistor can be reliably allowed to operate in the saturation region.

Preferably, when let $V_{DATA_MAX}$ ($V_{DATA_MAX}>0$) be the gate-source voltage of the driving transistor of which the driving current reaches its maximum value and let $V_{T1}$ ($V_{T1}>0$) be the threshold voltage of the driving transistor, the gate potential of the light-emission control transistor for the light emitting period is set so as to satisfy the following relation: $V_{G_ON}>V_{DATA_MAX}-V_{T1}+V_{T2}$. Since the driving transistor operates in the saturation region, therefore, the driving transistor can be used as a stable constant current source.

In another embodiment (e.g., a fourth embodiment which will be described below), preferably, the pixel circuit includes a writing control transistor (e.g., a transistor $SW_1$ shown in FIG. 12) arranged on a path extending from a node (e.g., a node $N_1$ shown in FIG. 12) between the driving transistor and the light-emission control transistor. The light-emission control transistor and the writing control transistor have the same conductivity type and size. The same potential as that at which the light-emission control transistor is turned on for the light emitting period is supplied to the gate of the writing control transistor for a writing period precedent to the light emitting period to turn on the writing control transistor. The gate potential of the driving transistor is set by a current (e.g., a current $I_{DATA}$ in FIG. 12) flowing through the driving transistor, the node, and the writing control transistor when the writing control transistor is turned on. In this case, since the potential supplied to the gate of the writing control transistor for the writing period is the same as that supplied to the gate of the light-emission control transistor for the light emitting period, the potential at the node between the driving transistor and the light-emission control transistor for the writing period substantially coincides with that for the light emitting period. Therefore, the amount of current flowing through the driving transistor for the writing period can be made coincide with that for the light emitting period with high accuracy.

According to another aspect of the invention, there is provided a driving circuit for driving a pixel circuit including a light emitting element that emits light by receiving a driving current, a driving transistor that generates the driving current, and a light-emission control transistor of the same conductivity type as that of the driving transistor, the light-emission control transistor being arranged on a path through which the driving current flows from the driving transistor to the light emitting element. The driving circuit includes a light-emission control circuit that sets the gate potential of the light-emission control transistor so that the light-emission control transistor is turned on in the saturation region for a light emitting period during which the light emitting element is allowed to emit light. In this case, since the light-emission control transistor operates in the saturation region for the light emitting period, the influence of the electrical characteristics of the light emitting element on the driving current can be reduced.

According to another aspect of the invention, a light emitting device includes a pixel circuit and a light-emission control circuit. The pixel circuit includes a light emitting element that emits light by receiving a driving current, a driving transistor that generates the driving current, and a light-emission control transistor of the same conductivity type as that of the driving transistor, the light-emission control transistor being arranged on a path through which the driving current flows from the driving transistor to the light emitting element. The light-emission control circuit sets the gate potential of the light-emission control transistor so that the light-emission control transistor is turned on in the saturation region for a light emitting period during which the light emitting element is allowed to emit light. In this case, since the light-emission control transistor operates in the saturation region for the light emitting period, the influence of the electrical characteristics of the light emitting device on the driving current can be reduced.

Preferably, the pixel circuit includes a writing control transistor, a writing control circuit, and a data supply circuit. The writing control transistor is arranged between a data line and a node located between the driving transistor and the light-emission control transistor. The writing control circuit turns on the writing control transistor for a writing period precedent to the light emitting period. The data supply circuit supplies a current to the data line for the writing period to set the gate potential of the driving transistor. The light-emission control transistor and the writing control transistor have the same conductivity type and size. The potential supplied from the writing control circuit to the gate of the writing control transistor for the writing period is equivalent to that supplied from the light-emission control circuit to the gate of the light-emission control transistor for the light emitting period. In this case, since the gate potential of the writing control transistor for the writing period is the same as that of the light-emission control transistor for the light emitting period, the amount of current flowing through the driving transistor for the writing period can be made coincide with that for the light emitting period with high accuracy.

The light emitting device of the invention may be used in various electronic apparatuses. Typical examples of the electronic apparatuses include apparatuses (e.g., a personal computer and a mobile phone) each including the light emitting device as a display. Applications of the light emitting device of the invention are not limited to apparatuses for image display. The light emitting device of the invention can be used in various applications, such as an exposure apparatus (exposure head) for irradiating an image carrier, e.g., a photosensitive drum with a light beam to form a latent image on the image carrier and various illuminating apparatuses including an apparatus (backlight), arranged on the rear of a liquid crystal display, for illuminating the display, and an apparatus, mounted on an image reader, e.g., a scanner, for illuminating a document sheet.

BRIEF DESCRIPTION OF THE DRAWINGS

The invention will be described with reference to the accompanying drawings, wherein like numbers reference like elements.

FIGS. 6A and 63 are graphs showing curves each representing the relationship between a potential $V_{DATA}$ and a driving current $I_{DR}$.

DESCRIPTION OF EXEMPLARY EMBODIMENTS

First Embodiment

Figure 1:
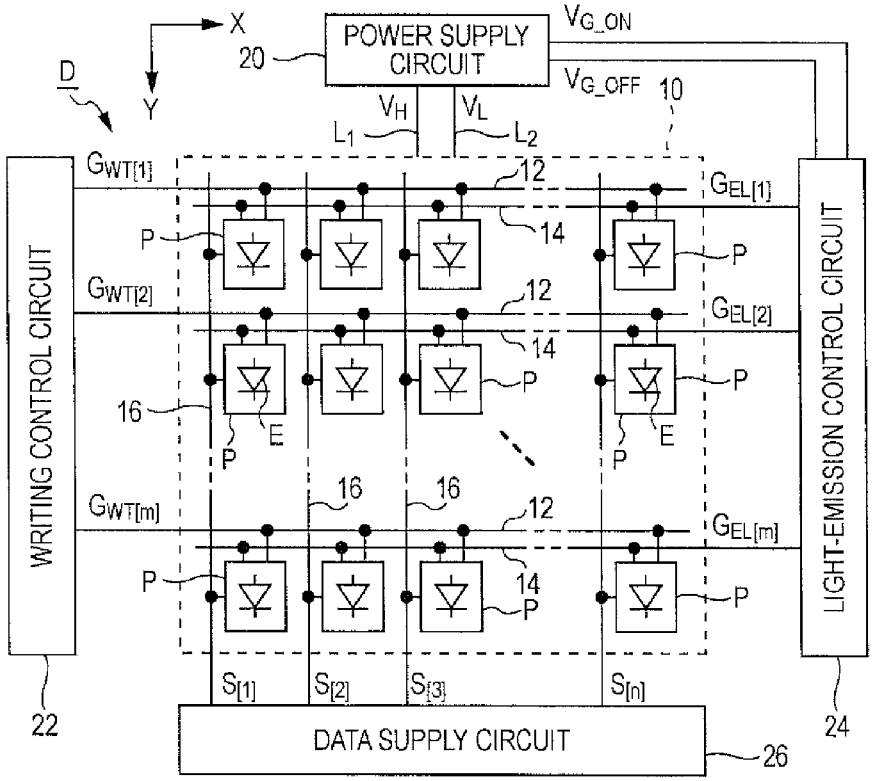
FIG. 1 is a block diagram of the structure of a light emitting device according to a first embodiment of the invention.

FIG. 1 is a block diagram of a light emitting device for use as an image display unit in various electronic apparatuses. A light emitting device D according to a first embodiment of the invention includes an element array 10 and peripheral circuits (i.e., a power supply circuit 20, a writing control circuit 22, a light-emission control circuit 24, and a data supply circuit 26). The element array 10 includes many pixel circuits P. The peripheral circuits control the pixel circuits P. Each pixel circuit P includes a light emitting element E which emits light by receiving a current.

In the element array 10, m selection lines 12 extending in the X direction, m light-emission control lines 14 extending in the X direction, and n data lines 16 extending in the Y direction that is perpendicular to the X direction (each of m and n is a natural number of two or more). Each light-emission control line 14 pairs with the corresponding selection line 12. Each pixel circuit P is arranged in the vicinities of the points of intersection of the selection line 12, the light-emission control line 14, and the data line 16. Therefore, these pixel circuits P are arranged in the X and Y directions in a matrix of m rows×n columns.

The power supply circuit 20 serves as a unit that generates a voltage for use in the light emitting device D. The power supply circuit 20 generates a high power supply potential $V_H$ and a low power supply potential $V_L$. The high power supply potential $V_H$ serves as a reference potential (0 V) for the voltages across respective components and is supplied to the element array 10 via a power supply line $L_1$. The low power supply potential $V_L$ is lower than the high power supply potential $V_H$ by a voltage $V_{EL}$ and is supplied to the element array 10 via a power supply line $L_2$. The power supply circuit 20 also generates an ON potential $V_{G_ON}$ and an OFF potential $V_{G_OFF}$ for use in the light-emission control circuit 24. In the present embodiment, the ON potential $V_{G_ON}$ is lower than the OFF potential $V_{G_OFF}$. The ON potential $V_{G_ON}$ and the OFF potential $V_{G_OFF}$ will be described in detail later.

Figure 2:
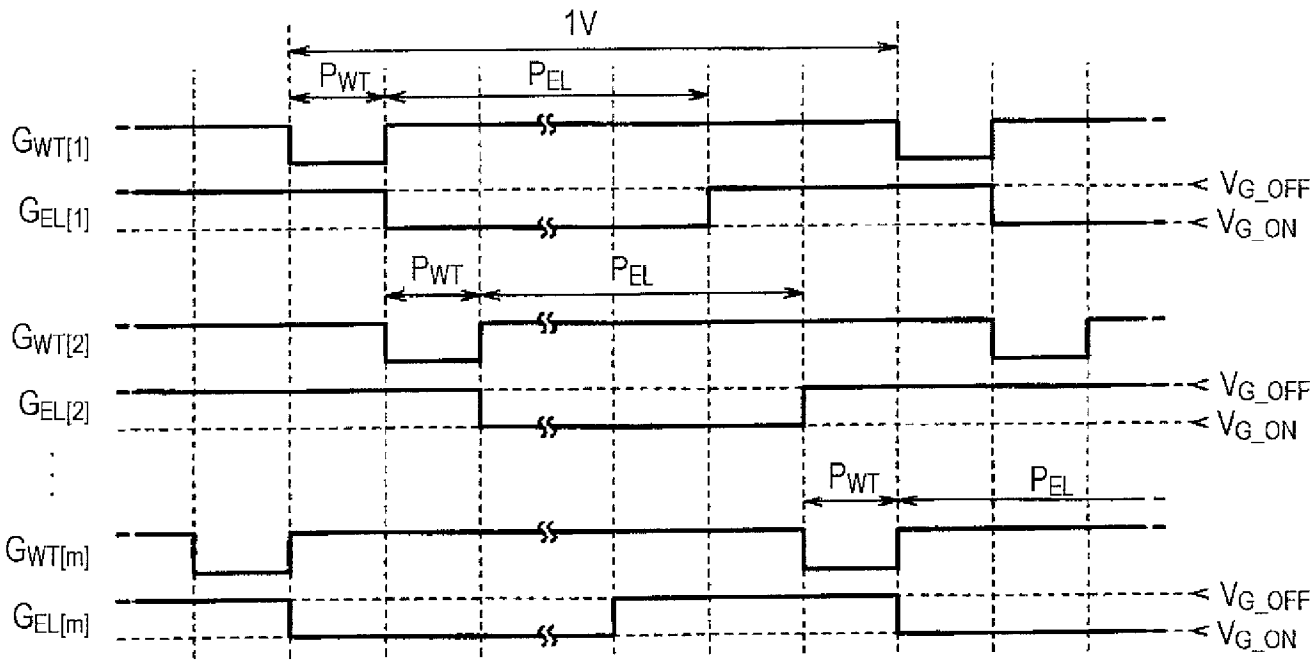
FIG. 2 is a timing chart showing the waveforms of selection signals and light-emission control signals.

The writing control circuit 22 serves as a unit (e.g., an m-bit shift register) that generates selection signals $G_{WT[1]}$ to $G_{WT[m]}$ for sequential selection of the m selection lines 12 and outputs the signals to the respective selection lines 12. Referring to FIG. 2, the selection signal $G_{WT[i]}$ supplied to the ith (i is a natural number satisfying $1 \leq i \leq m$) selection line 12 goes to a low level (selected) for an ith writing period (horizontal scanning period) $P_{WT}$ of one frame period (1V) and is held at a high level (unselected) for a period other than the writing period in one frame.

Again referring to FIG. 1, the light-emission control circuit 24 serves as a unit (e.g., an m-bit shift register) that generates light-emission control signals $G_{EL[1]}$ to $G_{EL[m]}$ for specifying a period (hereinafter, referred to as a light emitting period) during which the light emitting element E actually emits light and outputs the signals to the respective light-emission control lines 14. Referring to FIG. 2, the light-emission control signal $G_{EL[i]}$, supplied to the ith light-emission control line 14, becomes the ON potential $V_{G_ON}$ for a light emitting period $P_{EL}$ corresponding to a predetermined time length after the writing period $P_{WT}$, during which the selection signal $G_{WT[i]}$ becomes the low level. The light-emission control signal $G_{EL[i]}$ is held at the OFF potential $V_{G_OFF}$ for a period other than the light emitting period $P_{EL}$ in one frame.

Referring to FIG. 1, the data supply circuit 26 serves as a unit (e.g., n voltage-output D/A converters) for generating data signals $S_{[i]}$ to $S_{[n]}$ to specify a gray scale level (light intensity) of the light emitting element E and outputs the signals to the respective data lines 16. As for the data signal $S_{[j]}$ supplied to the jth data line 16 for the writing period $P_{WT}$ during which the selection signal $G_{WT[i]}$ becomes the low level, the data signal $S_{[j]}$ is controlled at a potential $V_{DATA}$ according to the specified gray scale level of the pixel circuit P at the intersection of the ith row and the jth column.

Figure 3:
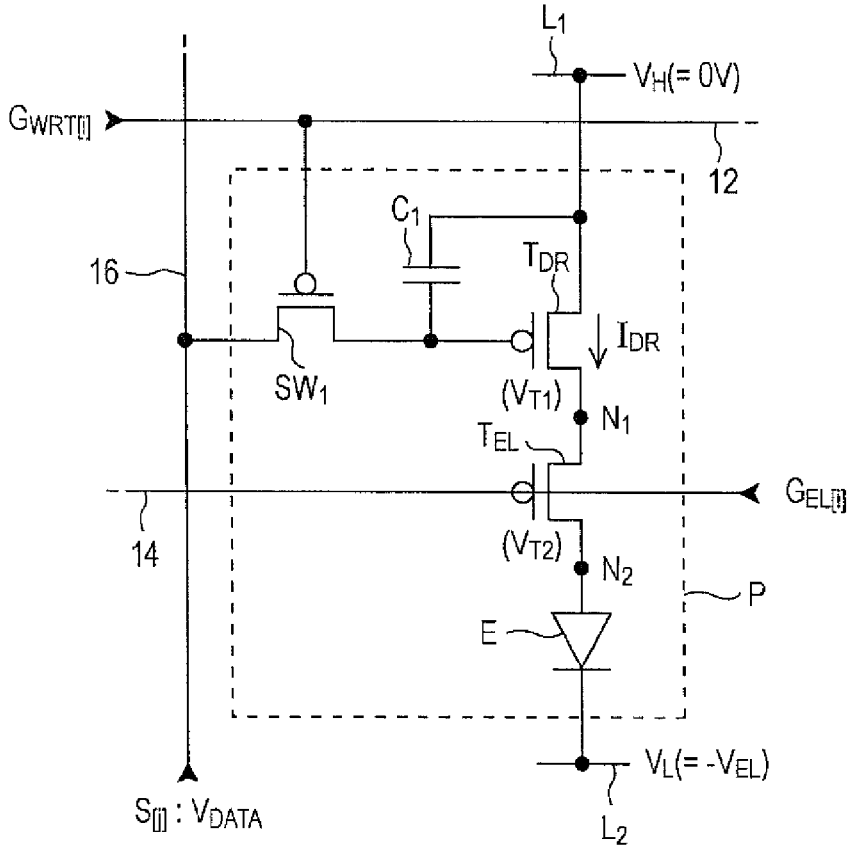
FIG. 3 is a circuit diagram of the structure of a pixel circuit according to the first embodiment.

The specific structure of each pixel circuit P will now be described with reference to FIG. 3. FIG. 3 illustrates only one pixel circuit P at the intersection of the ith row and the jth column. The pixel circuits P constituting the element array 10 have the same structure. Referring to FIG. 3, the light emitting element E in the pixel circuit P is arranged on a path connecting to both of the power supply lines $L_1$ and $L_2$. The light emitting element E in accordance with this embodiment is an organic light emitting diode including an anode, a cathode, and a luminous layer arranged between the anode and the cathode. The luminous layer comprises an organic electroluminescent (EL) material. The light emitting element E emits light having an intensity (luminance) according to the amount of the driving current $I_{DR}$ flowing between the anode and the cathode. The cathode of the light emitting element E is connected to the power supply line $L_2$.

A P-channel driving transistor $T_{DR}$ is arranged on the path through which the driving current $I_{DR}$ flows (between the power supply line $L_1$ and the light emitting element E). The driving transistor $T_{DR}$ serves as a unit that generates the driving current $I_{DR}$ whose amount depends on the gate potential. The source of the driving transistor $T_{DR}$ is connected to the power supply line $L_1$. A capacitor $C_1$ is arranged between the gate and the source (the power supply line $L_1$) of the driving transistor $T_{DR}$. A P-channel transistor $SW_1$ for controlling the electrical connection (conduction/non-conduction) between the gate of the driving transistor $T_{DR}$ and the data line 16 is arranged therebetween. The gates of the transistors $SW_1$ belonging to the ith row are connected to the ith selection line 12.

A light-emission control transistor $T_{EL}$ for controlling the electrical connection between the drain of the driving transistor $T_{DR}$ and the anode of the light emitting element E is arranged therebetween (i.e., on the path of the driving current $I_{DR}$ supplied from the driving transistor $T_{DR}$ to the light emitting element E). The conductivity type of the light-emission control transistor $T_{EL}$ is the P-channel type, the same as that of the driving transistor $T_{DR}$. The gates of the light-emission control transistors $T_{EL}$ belonging to the ith row are connected to the ith light-emission control line 14. The ON potential $V_{G_ON}$ generated by the power supply circuit 20 is set to a level at which the light-emission control transistor $T_{EL}$ is turned on when this potential is supplied to the gate thereof. The OFF potential $V_{G_OFF}$ is set to a level at which the light-emission control transistor $T_{EL}$ is turned off when this potential is supplied to the gate thereof.

When the selection signal $G_{WT[i]}$ goes to the low level during the writing period $P_{WT}$, the respective transistors $SW_1$ belonging to the ith row simultaneously switch to the ON state. In the pixel circuit P at the intersection of the ith row and the jth column, the potential $V_{DATA}$ of the data signal $S_{[j]}$ is supplied to the gate of the driving transistor $T_{DR}$ and electric charges according on the potential $V_{DATA}$ are stored in the capacitor $C_1$. The potential $V_{DATA}$ is set in accordance with a desired light intensity specified for the light emitting element E so that the driving transistor $T_{DR}$ operates in the saturation region when the light intensity of the light emitting element E reaches its maximum value. On the other hand, the light-emission control signal $G_{EL[i]}$ goes to the OFF potential $V_{G_OFF}$ during the writing period $P_{WT}$. Accordingly, while the light-emission control transistor $T_{EL}$ is held at the OFF state, the driving current $I_{DR}$ is interrupted, so that the light emitting element E is turned off.

After the writing period $P_{WT}$, the selection signal $G_{WT[i]}$ goes to the high level, so that each transistor $SW_1$ switches to the OFF state. The gate of the driving transistor $T_{DR}$ is held at the potential $V_{DATA}$ by the capacitor $C_1$ during the light emitting period $P_{EL}$ following the writing period $P_{WT}$. On the other hand, since the light-emission control signal $G_{EL[i]}$ is set to the ON potential $V_{G_ON}$ during the light emitting period $P_{EL}$, the light-emission control transistor $T_{EL}$ is turned on, thus establishing the path of the driving current $I_{DR}$. Therefore, the driving current $I_{DR}$ according to the potential $V_{DATA}$ at the gate of the driving transistor $T_{DR}$ is supplied to the light emitting element E via the power supply line $L_1$, the driving transistor $T_{DR}$, and the light-emission control transistor $T_{EL}$. Consequently, the light emitting element E emits light with a light intensity depending on the potential $V_{DATA}$.

A current $I_D$ flowing between the drain and the source of a transistor operating in the saturation region is expressed as the following Expression (1):

$$I_D=(\beta/2)(V_{GS}-V_T)^2(1+\lambda\cdot V_{DS}) \quad (1)$$

where β denotes the gain coefficient of the transistor, $V_T$ denotes the threshold voltage thereof, $V_{GS}$ indicates the gate-source voltage thereof, $V_{DS}$ denotes the drain-source voltage thereof, and λ denotes a channel length modulation coefficient representing a change (gradient) in the current $I_D$ when the voltage $V_{DS}$ changes by a unit amount in the saturation region. As will be understood from Expression (1), although the driving transistor $T_{DR}$ operates in the saturation region for the light emitting period $P_{EL}$, the driving current $I_{DR}$ (corresponding to the current $I_D$ in Expression (1)) depends on the drain-source voltage $V_{DS}$ of the driving transistor $T_{DR}$, more specifically, the potential at a node $N_1$ between the driving transistor $T_{DR}$ and the light-emission control transistor $T_{EL}$.

On the other hands, the electrical characteristics of each light emitting element E change due to various factors, such as an ambient temperature of the light emitting device D and elapsed time after formation of the light emitting element E. Furthermore, one light emitting device D has a variation in electrical characteristics between the light emitting elements E. Since the device D has a variation in characteristics between the light emitting elements E as described above, the potential at a node $N_2$ (the anode of the light emitting element E) between the light emitting element E and the light-emission control transistor $T_{EL}$ changes in accordance with the characteristics of the light emitting element E. Assuming that the light-emission control transistor $T_{EL}$ operates in a non-saturation region (linear region) for the light emitting period $P_{EL}$, the potential at the node $N_1$ (the voltage $V_{DS}$ across the driving transistor $T_{DR}$) changes in accordance with the potential at the node $N_2$. As will be understood from Expression (1), therefore, the driving current $I_{DR}$ changes in accordance with the characteristics of the light emitting element E. This leads to a variation in light intensity (gray scale level) between the respective light emitting elements E.

According to this embodiment, in order to solve the above-described disadvantages, the power supply circuit 20 generates the ON potential $G_{G_ON}$ so that each light-emission control transistor $T_{EL}$ is turned on in the saturation region for the light emitting period $P_{EL}$. When the channel length modulation coefficient λ is sufficiently small in Expression (1), the current $I_D$ flowing through the transistor is approximated by the following Expression (2):

$$I_D=(\beta/2)(V_{GS}-V_T)^2. \quad (2)$$

As will be understood from Expression (2), the current $I_D$ flowing through the transistor operating in the saturation region is determined by the gate-source voltage $V_{GS}$ and the threshold voltage $V_T$. In other words, when the current $I_D$ is fixed, the gate-source voltage $V_{GS}$ is also fixed to a predetermined value. Assuming that the light-emission control transistor $T_{EL}$ operates in the saturation region, the gate-source voltage $V_{GS}$ of the light-emission control transistor $T_{EL}$ is determined in accordance with the driving current $I_{DR}$ generated by the driving transistor $T_{DR}$. Therefore, the potential at the node $N_1$ is determined in accordance with the ON potential $V_{G_ON}$ supplied to the gate of the light-emission control transistor $T_{EL}$ and is not affected by a change of the potential at the node $N_2$ caused by a variation in the characteristics of the light emitting element E. In Expression (2), the influence of the channel length modulation effect of the light-emission control transistor $T_{EL}$ is ignored. If the channel length modulation effect is taken into consideration in a manner similar to Expression (1), since the channel length modulation coefficient λ is sufficiently small, the change of the potential at the node $N_1$ caused by the variation in the characteristics of the light emitting element E is sufficiently suppressed as compared to the case where the light-emission control transistor $T_{EL}$ operates in the non-saturation region. As described above, according to this embodiment, setting the operating point of the light-emission control transistor $T_{EL}$ within the saturation region suppresses the change of the potential at the node $N_1$. Advantageously, if there is a variation in the electrical characteristics of the light emitting element E, the driving current $I_{DR}$ according to the potential $V_{DATA}$ of the data signal $S_{[j]}$ can be generated with high accuracy.

When the driving current $I_{DR}$ approximates zero, the gate-source voltage $V_{GS}$ of the light-emission control transistor $T_{EL}$ sufficiently approximates the threshold voltage $V_{T2}$ of the light-emission control transistor $T_{EL}$. In other words, the difference between the ON potential $V_{G_ON}$ supplied to the gate of the light-emission control transistor $T_{EL}$ and the potential $V_{N1}$ at the node $N_1$ (the source of the light-emission control transistor $T_{EL}$), therefore, the gate-source voltage $V_{GS}$ of the light-emission control transistor $T_{EL}$ approximates the threshold voltage $V_{T2}$ ($V_{G_ON}-V_{N1}\approx V_{T2}$). Therefore, the potential $V_{N1}$ at the node $N_1$ is held in the neighborhood of the difference between the ON potential $V_{G_ON}$ and the threshold voltage $V_{T2}$ ($V_{N1}\approx V_{G_ON}-V_{T2}$). In other words, the characteristics of the light emitting element E are hardly affected by the potential $V_{N1}$ at the node $N_1$.

Conditions of the ON potential $V_{G_ON}$ necessary for the operation of the light-emission control transistor $T_{EL}$ in the saturation region will now be described. In order to allow the light-emission control transistor $T_{EL}$ to operate in the saturation region, it is necessary that the drain-source voltage $V_{DS}$ of the light-emission control transistor $T_{EL}$ should be below the difference between the gate-source voltage $V_{GS}$ and the threshold voltage $V_{T2}$ ($V_{T2}<0$) ($V_{DS}<V_{GS}-V_{T2}$). When let $V_{N2}$ be the potential at the node $N_2$, the above-described condition is expressed by the following Expression (a1):

$$V_{N2}<V_{G_ON}-V_{T2}. \quad \text{(a1)}$$

Let $V_{EL_MAX}$ be the voltage across the light emitting element E with a maximum voltage drop (i.e., when the voltage drop across the light emitting element E reaches its maximum value). The voltage $V_{EL_MAX}$ is determined with reference to a voltage applied to the anode in consideration of the range of variation in the characteristics of the light emitting element E and the driving current $I_{DR}$ ($V_{EL_MAX}<0$). In other words, the voltage $V_{EL_MAX}$ is the voltage across a light emitting element E when the maximum driving current $I_{DR}$ is supplied (the highest gray scale level is designated) to the light emitting element across which the voltage reaches its maximum value because of errors of the electrical characteristics of the many light emitting elements E constituting the element array 10. Since the maximum value of the potential $V_{N2}$ in Expression (a1) is expressed by ($-V_{EL}-V_{EL_MAX}$), the range of the ON potential $V_{G_ON}$ for the operation of the light-emission control transistor $T_{EL}$ in the saturation region is expressed by the following Expression (a2):

$$V_{G_ON}>-V_{EL}-V_{EL_MAX}+V_{T2}. \quad \text{(a2)}$$

In this embodiment, the driving transistor $T_{DR}$ operates in the saturation region for most of the range where the light intensity (gray scale level) of the light emitting element E changes. In order to allow the driving transistor $T_{DR}$ to operate in the saturation region, it is necessary that the drain-source voltage $V_{DS}$ of the transistor should be below the difference between the gate-source voltage $V_{GS}$ and the threshold voltage $V_{T1}$ ($V_{T1}<0$) ($V_{DS}<V_{GS}-V_{T1}$). When let $V_{DATA_MAX}$ be the maximum value of the potential $V_{DATA}$ of the data signal $S_{[j]}$, the above-described condition is expressed by the following Expression (a3):

$$V_{N1}<V_{DATA_MAX}-V_{T1}. \quad \text{(a3)}$$

The potential $V_{DATA_MAX}$ is the potential at the gate of the driving transistor $T_{DR}$ of which the driving current $I_{DR}$ reaches its maximum value (i.e., the highest gray scale level is designated) ($V_{DATA_MAX}<0$).

Further, in order to turn on the light-emission control transistor $T_{EL}$ for the light emitting period $P_{EL}$, it is necessary that the gate-source voltage of the light-emission control transistor $T_{EL}$ should be below the threshold voltage $V_{T2}$. In other words, the following Expression (a4) is satisfied:

$$V_{G_ON}-V_{N1}<V_{T2}. \quad \text{(a4)}$$

The following Expression (a5) is derived from the Expressions (a3) and (a4):

$$V_{G_ON}<V_{DATA_MAX}-V_{T1}+V_{T2}. \quad \text{(a5)}$$

Figure 4:
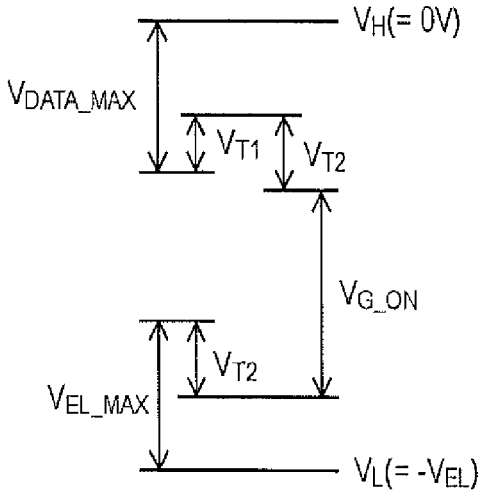
FIG. 4 is a conceptual diagram explaining the range of an ON potential $V_{G_ON}$.

The ON potential $V_{G_ON}$ is selected from the range satisfying the following Expression (a6) as shown in FIG. 4 using Expressions (a2) and (a5):

$$V_{DATA_MAX}-V_{T1}+V_{T2}>V_{G_ON}>-V_{EL}-V_{EL_MAX}+V_{T2}. \quad \text{(a6)}$$

As for the OFF potential $V_{G_OFF}$, a voltage at which the light-emission control transistor $T_{EL}$ is turned off may be used. For example, the high power supply potential $V_H$ (0 V) is used as the OFF potential $V_{G_OFF}$.

Figure 5:
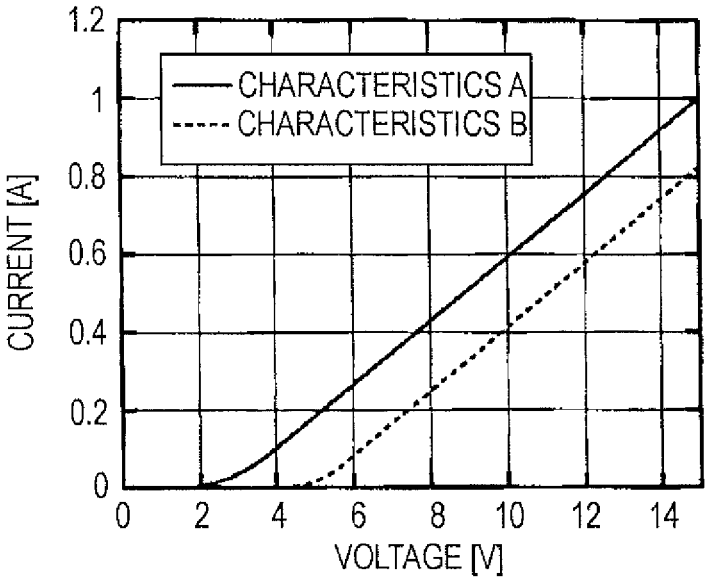
FIG. 5 is a graph showing curves each representing the relationship between current and voltage across a light emitting element.

An advantage obtained in the case where the light-emission control transistor $T_{EL}$ operates in the saturation region for the light emitting period $P_{EL}$ will now be described while being compared to the case (hereinafter, referred to as a comparative example) where the light-emission control transistor $T_{EL}$ operates in the non-saturation region. In the following description, it is assumed that the power supply potential $V_L$ of the power supply line $L_2$ is set to $-V_{EL}$ (=−18 V), the ON potential $V_{G_ON}$ in this embodiment is −9 V, and the ON potential $V_{G_ON}$ in the comparative example is −18 V. It is further assumed that a light emitting elements E has characteristics A and another light emitting element E has characteristics B as shown in FIG. 5. Referring to FIG. 5, when the driving current $I_{DR}$ is set to the same value in both of the light emitting elements E, the voltage across the light emitting element E having the characteristics B is higher than that of the light emitting element E having the characteristics A.

Figure 6A:
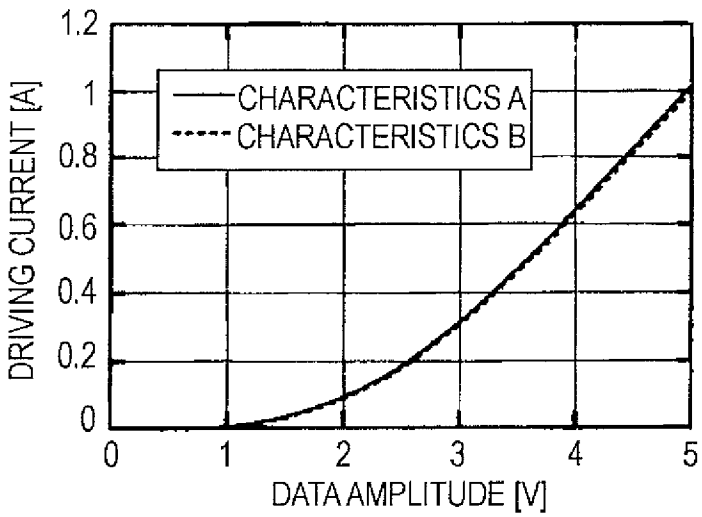
Figure 6B:
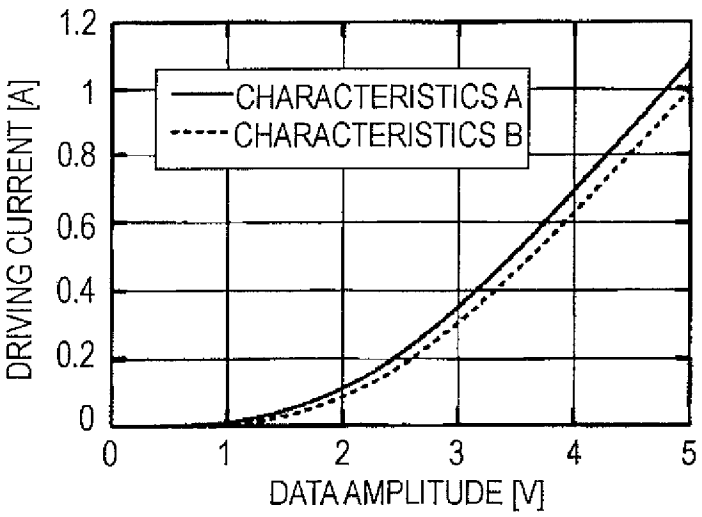

FIGS. 6A and 6B are graphs showing the relationship between the amplitude (absolute value) of the potential $V_{DATA}$ and the driving current $I_{DR}$ with respect to the characteristics A and B. FIG. 6A shows results in this embodiment. FIG. 6B shows results in the comparative example. In the comparative example, in the use of the same potential $V_{DATA}$, the driving currents $I_{DR}$ differ from each other in accordance with the characteristics of the respective light emitting elements E. On the other hand, in this embodiment, in the use of the same potential $V_{DATA}$, the value of the driving current $I_{DR}$ flowing to the light emitting element E having the characteristics A accurately coincides with that flowing to the other light emitting element B having the characteristics B.

Figure 7A:
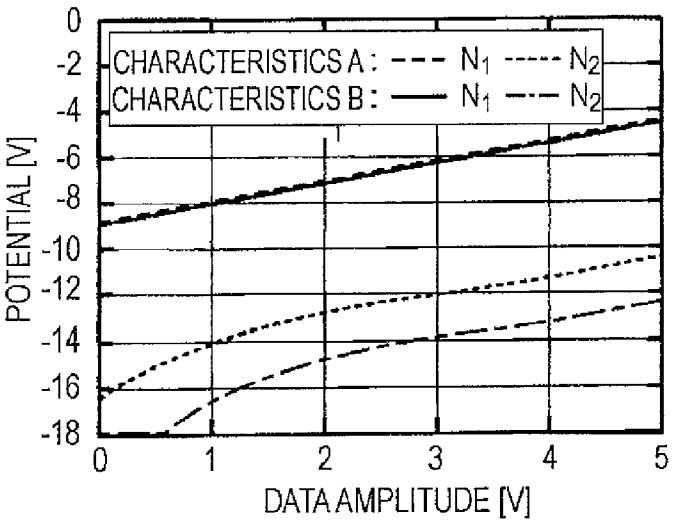
FIGS. 7A and 7B are graphs showing curves each representing the relationship between the potential $V_{DATA}$ and the potential at a node.
Figure 7B:
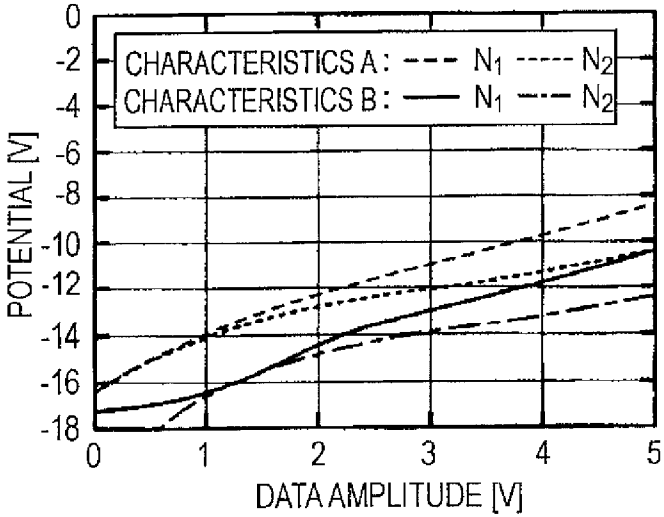

FIGS. 7A and 73 are graphs showing the relationship between the amplitude of the potential $V_{DATA}$ and the potentials at the nodes ($N_1$ and $N_2$) with respect to the characteristics A and B. Similar to FIGS. 6A and 6B, FIG. 7A shows results in this embodiment and FIG. 7B shows results in the comparative example. Referring to FIG. 7B, when each light-emission control transistor $T_{EL}$ operates in the non-saturation region, the potential at the node $N_2$ changes in accordance with the characteristics of the corresponding light emitting element E. Further, the potential at the node $N_1$ changes in association with the potential at the node $N_2$. On the other hand, referring to FIG. 7A, the potential at the node $N_2$ changes in accordance with the characteristics of each light emitting element E in this embodiment. However, since each light-emission control transistor $T_{EL}$ operates in the saturation region, the potential at the node $N_1$ does not change in both of the light emitting element E having the characteristics A and that having the characteristics B.

As for an arrangement for maintaining the potential at the node $N_1$ at a predetermined value irrespective of the characteristics of the corresponding light emitting element E, for example, a transistor (hereinafter, referred to as a buffer transistor) different from the light-emission control transistor $T_{EL}$ may be arranged between the light-emission control transistor $T_{EL}$ and the driving transistor $T_{DR}$. During the light emitting period $P_{EL}$, the light-emission control transistor $T_{EL}$ is allowed to operate in the non-saturation region in a manner similar to the comparative example and the buffer transistor is allowed to operate in the saturation region, thus reducing the influence of the characteristics of the light emitting element E on the potential at the node $N_1$. Unfortunately, the number of transistors constituting the pixel circuit P is increased by adding the buffer transistor. On the other hand, in this embodiment, one light-emission control transistor $T_{EL}$ realizes a function of a switching element for controlling supply of the driving current $I_{DR}$ to the corresponding light emitting element E and a function for reducing the influence of the electrical characteristics of the light emitting element E on the potential at the node $N_1$. Advantageously, the structure of the pixel circuit P can be simplified as compared to the arrangement with the buffer transistor.

Second Embodiment

A second embodiment of the invention will now be described. Components having the same functions and operations as those of the components in the first embodiment are designated by the same reference numerals and a detail description thereof is omitted.

Figure 8:
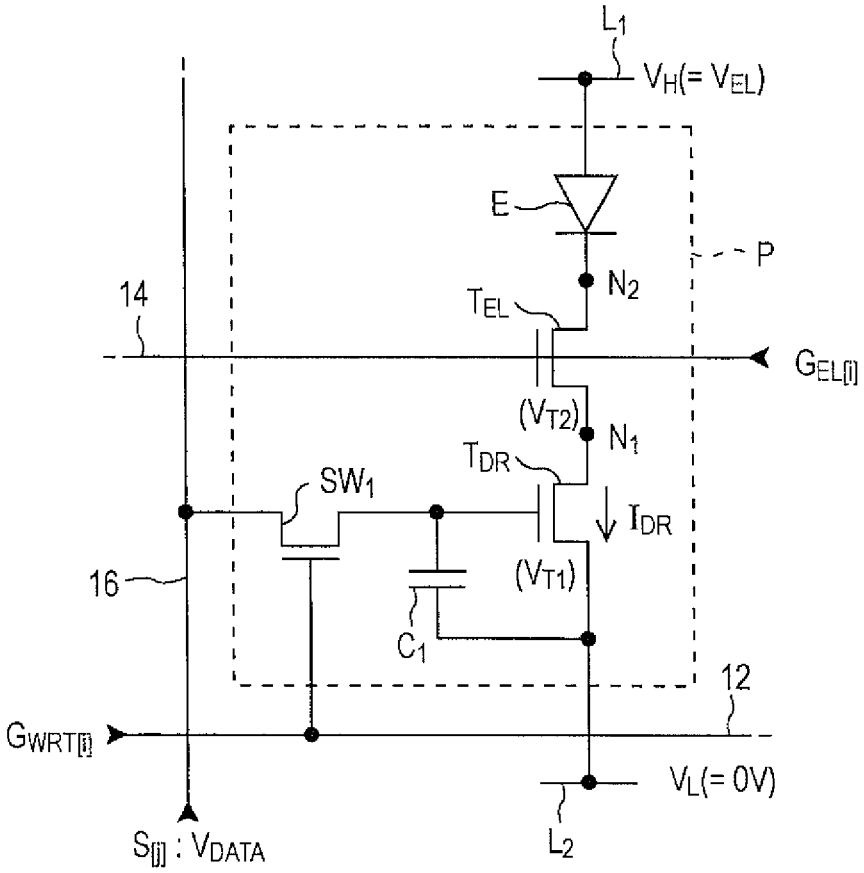
FIG. 8 is a circuit diagram of the structure of a pixel circuit according to a second embodiment of the invention.

FIG. 8 is a circuit diagram of the structure of a pixel circuit P in the second embodiment. As shown in FIG. 8, transistors (e.g., a driving transistor $T_{DR}$, a light-emission control transistor $T_{EL}$, and a transistor $SW_1$) constituting the pixel circuit P are of N-channel type. Therefore, the relationship among power supply lines $L_1$ and $L_2$ and components of the pixel circuit P is the reverse of that in the first embodiment. In other words, the anode of a light emitting element E is connected to the power supply line $L_1$ and the source of the driving transistor $T_{DR}$ is connected to the power supply line $L_2$. The potential $V_L$ of the power supply line $L_2$ is a reference potential (0 V) for the voltages across respective components. The potential $V_H$ of the power supply line $L_1$ is higher than the potential $V_L$ by a voltage $V_{EL}$ ($V_{EL}>0$). The light-emission control transistor $T_{EL}$ is arranged between the cathode of the light emitting element E and the drain of the driving transistor $T_{DR}$. The position of the transistor $SW_1$ and that of a capacitor $C_1$ are the same as those in the first embodiment.

A light-emission control signal $G_{EL[i]}$ becomes an ON potential $V_{G_ON}$ for a light emitting period $P_{EL}$ and is held at an OFF potential $V_{G_OFF}$ for a period other than the light emitting period $P_{EL}$ in a manner similar to the first embodiment. Since the light-emission control transistor $T_{EL}$ is of N-channel type, the ON potential $V_{G_ON}$ is higher than the OFF potential $V_{G_OFF}$. The ON potential $V_{G_ON}$ is determined so that the light-emission control transistor $T_{EL}$ operates in the saturation region in a manner similar to the first embodiment. Conditions for the ON potential $V_{G_ON}$ will be described below.

Since it is necessary that the drain-source voltage $V_{DS}$ of the light-emission control transistor $T_{EL}$ should exceed the difference between the gate-source voltage $V_{GS}$ and the threshold voltage $V_{T2}$ ($V_{T2}>0$) of the transistor so that the transistor operates in the saturation region, the following Expression (b1) is satisfied:

$$V_{N2}>V_{G_ON}-V_{T2}. \quad \text{(b1)}$$

Since the maximum potential $V_{N2}$ in Expression (b1) is expressed as $V_{EL}-V_{EL_MAX}$, the following Expression (b2) is derived from Expression (b1) ($V_{EL_MAX}>0$):

$$V_{G_ON}<V_{EL}-V_{EL_MAX}+V_{T2}. \quad \text{(b2)}$$

In addition, since it is necessary that the drain-source voltage $V_{DS}$ of the driving transistor $T_{DR}$ should exceed the difference between the gate-source voltage $V_{GS}$ and the threshold voltage $V_{T1}$ ($V_{T1}>0$) of the transistor in order to allow the driving transistor $T_{DR}$ to operate in the saturation region, the following Expression (b3) is satisfied:

$$V_{N1}>V_{DATA_MAX}-V_{T1}. \quad \text{(b3)}$$

A potential $V_{DATA_MAX}$ ($V_{DATA_MAX}>0$) in Expression (b3) is the potential (maximum value of a potential $V_{DATA}$) at the gate of the driving transistor $T_{DR}$ of which a driving current $I_{DR}$ reaches its maximum value.

Further, since the light-emission control transistor $T_{EL}$ switches to the ON state during the light emitting period $P_{EL}$, the following Expression (b4) is satisfied:

$$V_{G_ON}-V_{N1}>V_{T2}. \quad \text{(b4)}$$

The following Expression (b5) is derived from Expressions (b3) and (b4):

$$V_{G_ON}>V_{DATA}-\text{MAX}-V_{T1}+V_{T2}. \quad \text{(b5)}$$

Figure 9:
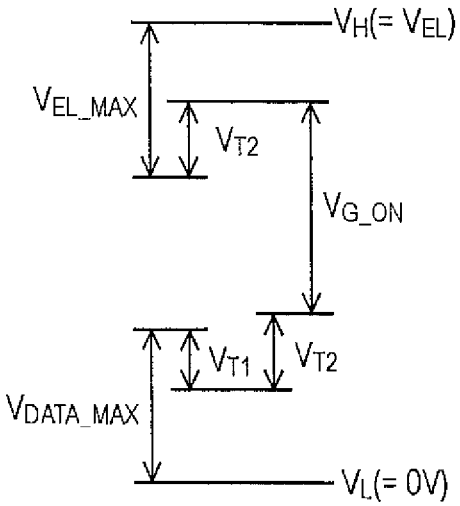
FIG. 9 is a conceptual diagram explaining the range of an ON potential $V_{G_ON}$.

The ON potential $V_{G_ON}$ in this embodiment is selected from the range satisfying the following Expression (b6) using Expressions (b2) and (b5) as shown in FIG. 9:

$$V_{DATA_MAX}-V_{T1}+V_{T2}<V_{G_ON}<V_{EL}-V_{EL_MAX}+V_{T2}. \quad \text{(b6)}$$

As for the OFF potential $V_{G_OFF}$, a potential at which the light-emission control transistor $T_{EL}$ is turned off may be used. For example, the low power supply potential $V_L$ (0 V) may be used as the OFF potential $V_{G_OFF}$.

As described above, since the light-emission control transistor $T_{EL}$ operates in the saturation region during the light emitting period $P_{EL}$ in this embodiment, the influence of the electrical characteristics of each light emitting element E on the driving current $I_{DR}$ flowing therethrough can be reduced.

Third Embodiment

Figure 10:
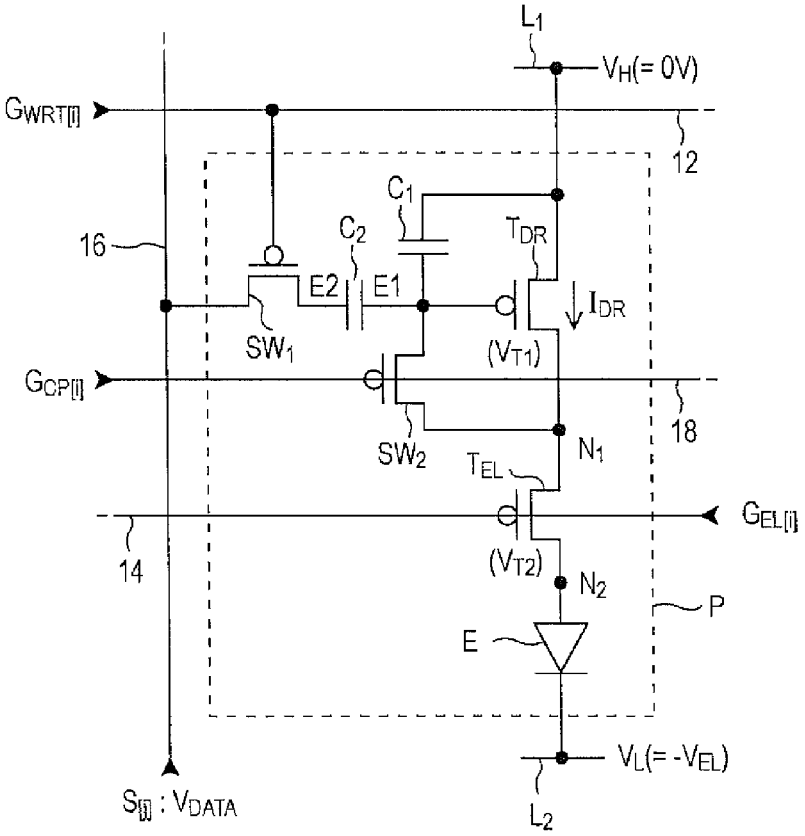
FIG. 10 is a circuit diagram of the structure of a pixel circuit according to a third embodiment of the invention.

FIG. 10 is a circuit diagram of the structure of a pixel circuit P according to a third embodiment of the invention. Referring to FIG. 10, the pixel circuit P according to this embodiment includes a transistor $SW_2$ and a capacitor $C_2$ in addition to the same components as those in the first embodiment. The transistor $SW_2$ is a P-channel transistor, arranged between the gate and the drain of a driving transistor $T_{DR}$, for controlling the electrical connection between the gate and the drain. A control signal $G_{CP[i]}$ is supplied from a driving circuit (not shown) to the gate of the transistor $SW_2$ via a control line 18. The capacitor $C_2$ includes an electrode $E_1$ and an electrode $E_2$. The electrode $E_1$ is connected to the gate of the driving transistor $T_{DR}$. The transistor $SW_2$, arranged between the electrode $E_2$ and a data line 16, controls the electrical connection therebetween.

Figure 11:
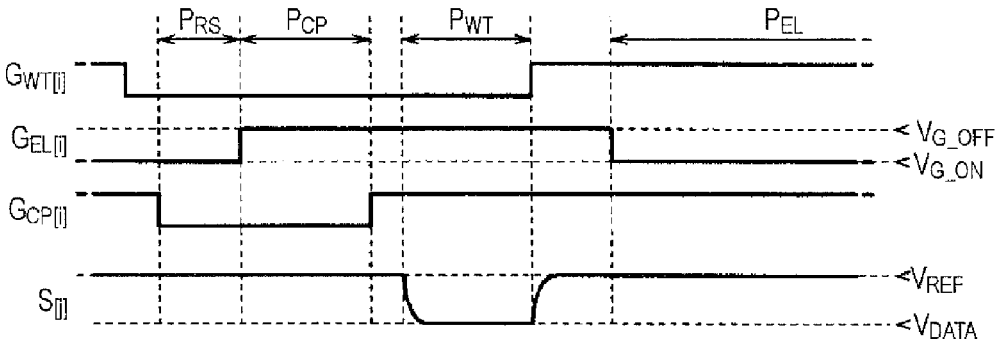
FIG. 11 is a timing chart explaining the operation of the pixel circuit shown in FIG. 10.

FIG. 11 is a timing chart showing the waveforms of signals supplied to the pixel circuit P at the intersection of the ith row and the jth column. Referring to FIG. 11, a resetting period $P_{RS}$ and a compensating period $P_{CP}$ are set just before a writing period $P_{WT}$. A selection signal $G_{WT[i]}$ becomes a low level during the resetting period $P_{RS}$, the compensating period $P_{CP}$, and the writing period $P_{WT}$ and becomes a high level for a light emitting period $P_{EL}$. A light-emission control signal $G_{EL[i]}$ goes to an ON potential $V_{G_ON}$ for each of the resetting period $P_{RS}$ and the light emitting period $P_{EL}$ and goes to an OFF potential $V_{G_OFF}$ ($V_{G_OFF}>V_{G_ON}$) during the compensating period $P_{CP}$ and the writing period $P_{WT}$. The control signal $G_{CP[i]}$ becomes a low level during the resetting period $P_{RS}$ and the compensating period $P_{CP}$ and becomes a high level during the writing period $P_{WT}$ and the light emitting period $P_{EL}$.

The operation of one pixel circuit P will now be described. Since the light-emission control signal $G_{EL[i]}$ becomes the ON potential $V_{G_ON}$ during the resetting period $P_{RS}$, a light-emission control transistor $T_{EL}$ is held in the ON state. Since the control signal $G_{CP[i]}$ changes to the low level during this period, the gate of the driving transistor $T_{DR}$ is connected to its drain via the transistor $SW_2$. During the resetting period $P_{RS}$, therefore, the gate (electrode $E_1$) of the driving transistor $T_{DR}$ is initialized to a voltage according to the electrical characteristics of the light emitting element E. During the resetting period $P_{RS}$ and the compensating period $P_{CP}$, while the transistor $SW_2$ is being held in the ON state in response to the selection signal $G_{WT[i]}$, a data signal $S_{[j]}$ is held at a reference potential $V_{REF}$. Consequently, the electrode $E_2$ is held at the reference potential $V_{REF}$.

When the compensating period $P_{CP}$ starts, the light-emission control signal $G_{EL[i]}$ changes to the OFF potential $V_{G_OFF}$, so that the light-emission control transistor $T_{EL}$ is turned off. Therefore, the potential at the gate of the driving transistor $T_{DR}$ (i.e., the electrode $E_1$ of the capacitor $C_2$) converges on a level corresponding to the difference between the power supply potential $V_H$ (0 V) of the power supply line $L_1$ and the threshold voltage $V_{T1}$ of the driving transistor $T_{DR}$ until the compensating period $P_{CP}$ terminates.

During the writing period $P_{WT}$, the change of the control signal $G_{CP[i]}$ to the high level causes the gate of the driving transistor $T_{DR}$ to disconnect its drain and the data signal $S_{[j]}$ changes from the reference potential $V_{REF}$ to a potential $V_{DATA}$ while the transistor $SW_2$ is being held in the ON state. Since the impedance at the gate of the driving transistor $T_{DR}$ is sufficiently high, the potential at the electrode $E_1$ (i.e., the potential at the gate of the driving transistor $T_{DR}$) changes in accordance with a change of the potential at the electrode $E_2$ (i.e., a change of the difference between the reference potential $V_{REF}$ and the potential $V_{DATA}$). In other words, the gate of the driving transistor $T_{DR}$ is set to a potential depending on the potential $V_{DATA}$. During the light emitting period $P_{EL}$, after the writing period $P_{WT}$, setting of the light-emission control signal $G_{EL[i]}$ to the ON potential $V_{G_ON}$ causes the light-emission control transistor $T_{EL}$ to turn on, so that a driving current $I_{DR}$ depending on the potential at the gate of the driving transistor $T_{DR}$ is supplied to the light emitting element E via the light-emission control transistor $T_{EL}$. Consequently, the light emitting element E emits light with an intensity depending on the potential $V_{DATA}$.

As described above, in this embodiment, the potential at the gate of the driving transistor $T_{DR}$ is allowed to converge on a potential corresponding to the threshold voltage $V_{T1}$ for the compensating period $P_{CP}$ and is changed using the capacitor $C_2$ for the writing period $P_{WT}$, so that the gate of the driving transistor $T_{DR}$ is set to a potential depending on the potential $V_{DATA}$. Therefore, an error in the threshold voltage $V_{T1}$ of the driving transistor $T_{DR}$ can be compensated for and the driving current $I_{DR}$ depending on the potential $V_{DATA}$ can be generated with high accuracy.

The ON potential $V_{G_ON}$ in this embodiment is selected from the range expressed by the following Expression (c) for allowing the light-emission control transistor $T_{EL}$ and the driving transistor $T_{DR}$ to operate in the saturation region in a manner similar to the first embodiment using Expression (a6). Therefore, the same advantages as those of the first embodiment are obtained in this embodiment.

$$V_{DATA_MAX}-V_{T1}+V_{T2}>V_{G_ON}>-V_{EL}-V_{EL_MAX}+V_{T2} \quad (c)$$

A potential $V_{DATA_MAX}$ in this embodiment is the potential at the gate of the driving transistor $T_{DR}$ set during the writing period $P_{WT}$ when the potential $V_{DATA}$ is selected so that the driving current $I_{DR}$ reaches its maximum value and is different from the potential $V_{DATA}$ of the data line 16.

Fourth Embodiment

A fourth embodiment of the invention will now be described. The foregoing embodiments have described the pixel circuits P of a voltage programming type in which the light intensity of each light emitting element E is set in accordance with the potential $V_{DATA}$ of the data line 16. Pixel circuits P according to the fourth embodiment are of a current programming type in which the light intensity of each light emitting element E is set in accordance with a current $I_{DATA}$ flowing through a data line 16.

Figure 12:
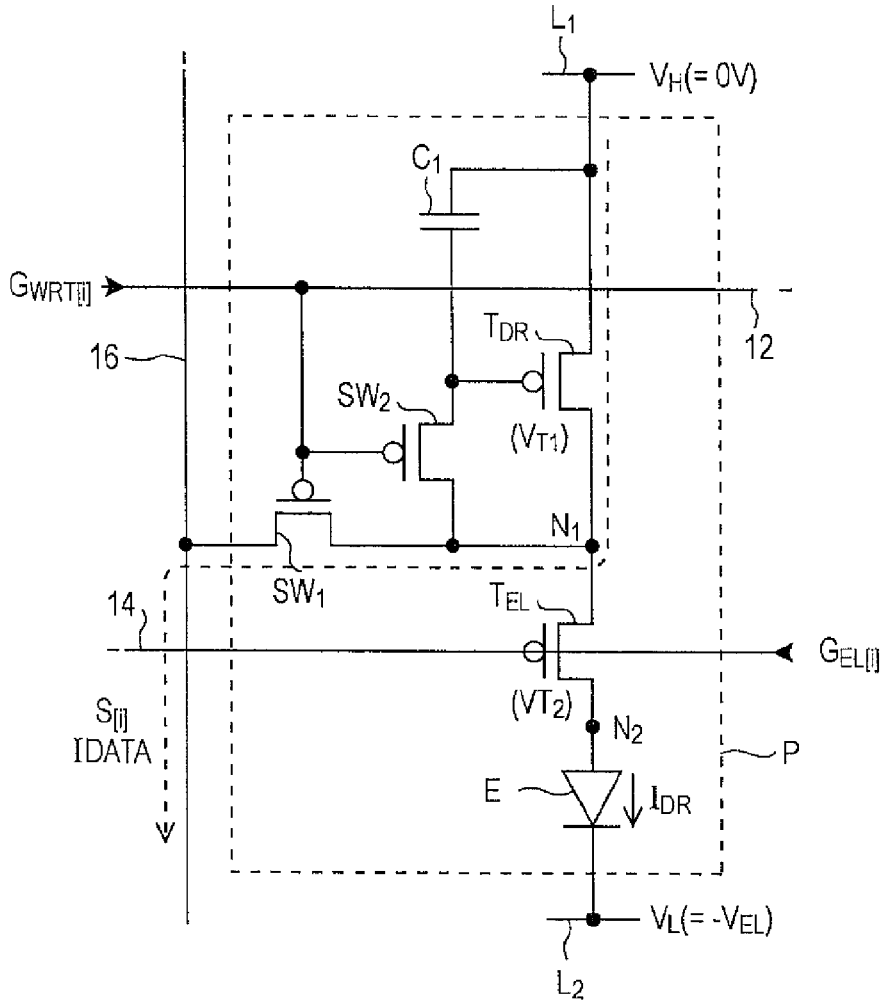
FIG. 12 is a circuit diagram of the structure of a pixel circuit according to a fourth embodiment of the invention.

FIG. 12 is a circuit diagram showing the structure of a pixel circuit P. Referring to FIG. 12, the pixel circuit P according to this embodiment includes transistors $SW_1$ and $SW_2$ of P-channel type which is the same as that of a driving transistor $T_{DR}$ and that of a light-emission control transistor $T_{EL}$. The transistor $SW_1$ is arranged on a path extending between the data line 16 and a node $N_1$, which is located between the driving transistor $T_{DR}$ and the light-emission control transistor $T_{EL}$. The transistor $SW_1$ controls the electrical connection between the drain of the driving transistor $T_{DR}$ and the data line 16. The transistor $SW_1$ and the light-emission control transistor $T_{EL}$ are arranged close to each other and have the same size (channel length, channel width). The transistor $SW_2$ controls the electrical connection between the gate and the drain of the driving transistor $T_{DR}$. The gates of the respective transistors $SW_1$ and $SW_2$ are connected to a selection line 12.

Figure 13:
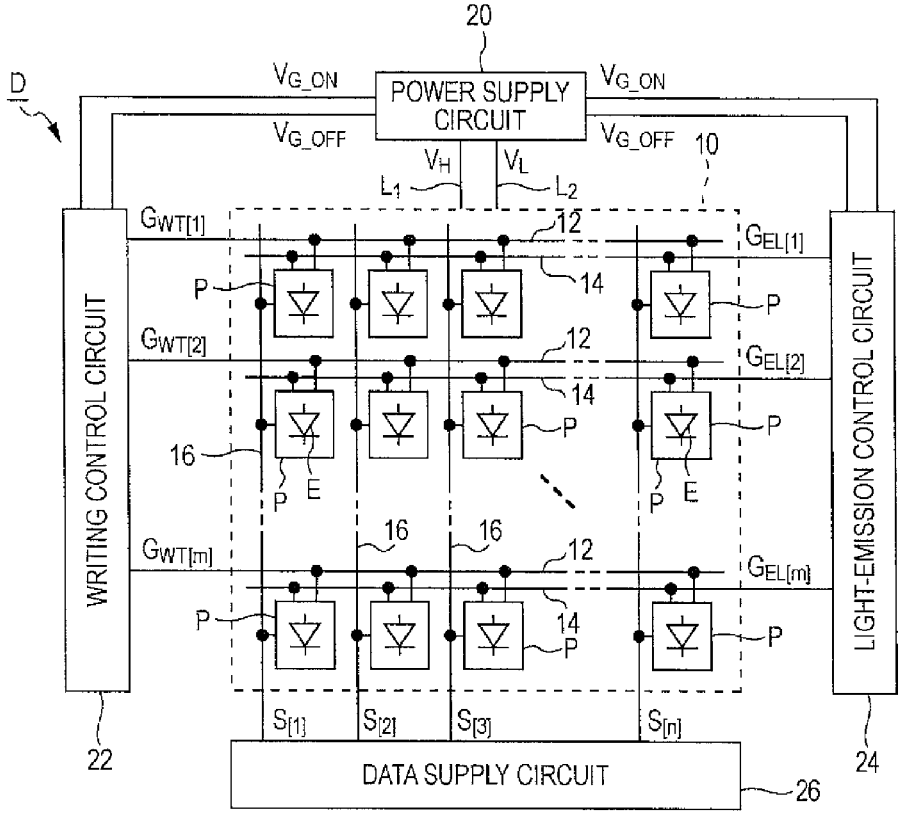
FIG. 13 is a block diagram of the structure of a light emitting device according to the fourth embodiment.
Figure 14:
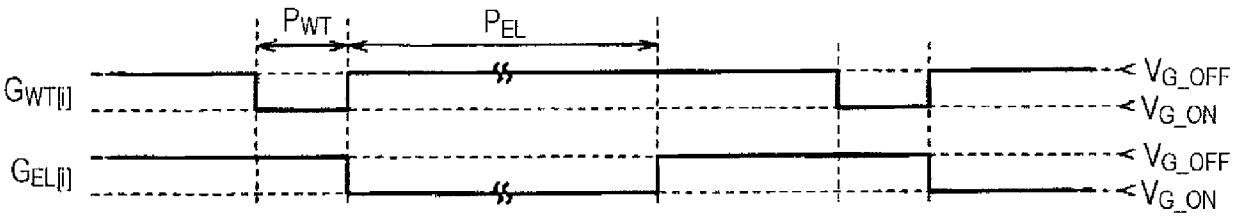
FIG. 14 is a timing chart showing the waveforms of a selection signal and a light-emission control signal.

FIG. 13 is a block diagram of the structure of a light emitting device D according to this embodiment. Referring to FIG. 13, a power supply circuit 20 supplies an ON potential $V_{G_ON}$ and an OFF potential $V_{G_OFF}$ to each of a light-emission control circuit 24 and a writing control circuit 22 ($V_{G_ON}<V_{G_OFF}$). As shown in FIG. 14, the writing control circuit 22 sets a selection signal $G_{WT[i]}$ to the ON potential $V_{G_ON}$ for a writing period $P_{WT}$ and sets the selection signal to the OFF potential $V_{G_OFF}$ for a period (including a light emitting period $P_{EL}$) other than the writing period $P_{WT}$. The waveform of a light-emission control signal $G_{EL[i]}$ is the same as that in the first embodiment.

A data supply circuit 26 serves as a unit (for example, n current-output D/A converters) for setting a data signal $S_{[j]}$ to a current $I_{DATA}$ depending on a gray scale level designated for a pixel circuit P at the intersection of the ith row and the jth column for the writing period $P_{WT}$ during which the selection signal $G_{WT[i]}$ becomes the ON potential $V_{G_ON}$.

In the above-described arrangement, when the selection signal $G_{WT[i]}$ changes to the ON potential $V_{G_ON}$ during the writing period $P_{WT}$, the gate of the driving transistor $T_{DR}$ is connected to its drain via the transistor $SW_2$. In addition, the supply of the ON potential $V_{G_ON}$ causes the transistor $SW_1$ to turn on. Therefore, the current $I_{DATA}$ of the data signal $S_{[j]}$ flows from a power supply line $L_1$ into the jth data line 16 via the driving transistor $T_{DR}$, the node $N_1$, and the transistor $SW_1$ as shown by a broken line in FIG. 12. Consequently, a voltage depending on the current $I_{DATA}$ is held in a capacitor $C_1$.

During the light emitting period $P_{EL}$ after the writing period $P_{WT}$, the selection signal $G_{WT[i]}$ is set to the OFF potential $V_{G_OFF}$, so that the transistors $SW_1$ and $SW_2$ are turned off. When the light-emission control signal $G_{EL[i]}$ changes to the ON potential $V_{G_ON}$ and the light-emission control transistor $T_{EL}$ is turned on, a driving current $I_{DR}$ according to the potential at the gate of the driving transistor $T_{DR}$ (i.e., a potential held by the capacitor $C_1$ for the preceding writing period $P_{WT}$) is supplied to the light emitting element E via the light-emission control transistor $T_{EL}$. Consequently, the light emitting element E emits light with an intensity depending on the current $I_{DATA}$.

In this embodiment, the ON potential $V_{G_ON}$ is selected from the range expressed by the following Expression (d) in which the light-emission control transistor $T_{EL}$ is allowed to operate in the saturation region in a manner similar to the first embodiment using Expression (a6). Therefore, the same advantages as those of the first embodiment are obtained in this embodiment.

$$V_{DATA_MAX}-V_{T1}+V_{T2}>V_{G_ON}>-V_{EL}-V_{EL_MAX}+V_{T2} \quad (d)$$

A potential $V_{DATA_MAX}$ in Expression (d) is the potential ($V_{DATA_MAX}<0$) at the gate of the driving transistor $T_{DR}$ set during the writing period $P_{WT}$ when the current $I_{DATA}$ is selected so that the driving current $T_{DR}$ reaches its maximum value.

In this embodiment, the transistor $SW_1$ and the light-emission control transistor $T_{EL}$ are arranged close to each other and have the same characteristics (i.e., the same conductivity type and the same size). Further, the transistor $SW_1$ and the light-emission control transistor $T_{EL}$ are turned on according to the same ON potential $V_{G_ON}$. With this arrangement, the potential at the node $N_1$ (potential at the drain of the driving transistor $T_{DR}$) for the writing period $P_{WT}$ coincides with that for the light emitting period $P_{EL}$. Therefore, the amount of the current $I_{DATA}$ for the writing period $P_{WT}$ can be accurately made coincide with that of the driving current $I_{DR}$ for the light emitting period $P_{EL}$. In other words, the light intensity of the light emitting element E can be controlled with high accuracy in accordance with the current $I_{DATA}$.

Modifications

The above-described embodiments may be variously modified. Modifications will be described below. The following modifications may be appropriately used in combination.

First Modification

In each of the first to third embodiments, the ON potential $V_{G_ON}$ and the OFF potential $V_{G_OFF}$ generated by the power supply circuit 20 may be used as voltages for the selection signals $G_{WT[1]}$ to $G_{WT[m]}$ generated by the writing control circuit 22 in a manner similar to the fourth embodiment. With this arrangement, the number of voltages generated by the power supply circuit 20 is reduced, thus achieving a reduction in scale of the power supply circuit 20 and a reduction in power consumption.

Second Modification

In each of the third and fourth embodiments, each pixel circuit P includes P-channel transistors. The conductivity type of transistors in FIGS. 10 and 12 may be appropriately changed to N-channel type in a manner similar to the second embodiment. Further, it is unnecessary that all of transistors constituting each pixel circuit P have the same conductivity type. In other words, so long as the driving transistor $T_{DR}$ and the light-emission control transistor $T_{EL}$ have the same conductivity type, the transistors $SW_1$ and $SW_2$ may have any conductivity type.

Third Modification

With the arrangement in which the driving transistor $T_{DR}$ operates in the saturation region in the same way as in the foregoing embodiments, the driving transistor $T_{DR}$ can be allowed to serve as a constant current source for stably generating the driving current $I_{DR}$. Since the desired advantages of the invention are obtained so long as the light-emission control transistor $T_{EL}$ operates in the saturation region, it is not always necessary to set the operating point of the driving transistor $T_{DR}$ in the saturation region. For example, it is unnecessary to satisfy Expression (a5) in the first embodiment and Expression (b5) in the second embodiment.

Fourth Modification

In each of the above-described embodiments, the organic light-emitting diode has been described as the light emitting element E. The invention can be applied to various light emitting devices using light emitting elements other than the organic light-emitting diodes. Various light emitting elements, such as a light emitting diode each including a luminous layer made of an inorganic electroluminescent material, a field emission (FE) element, a surface-conduction electron-emitter (SE), and a ballistic electron surface emitting (BS) element, may be used in the invention.

Applications

Figure 15:
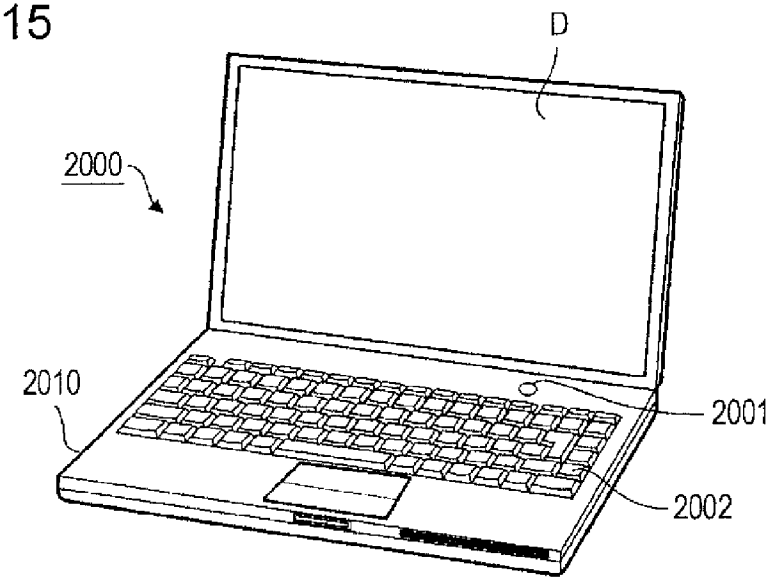
FIG. 15 is a perspective view of an electronic apparatus (personal computer) to which the invention is applied.
Figure 16:
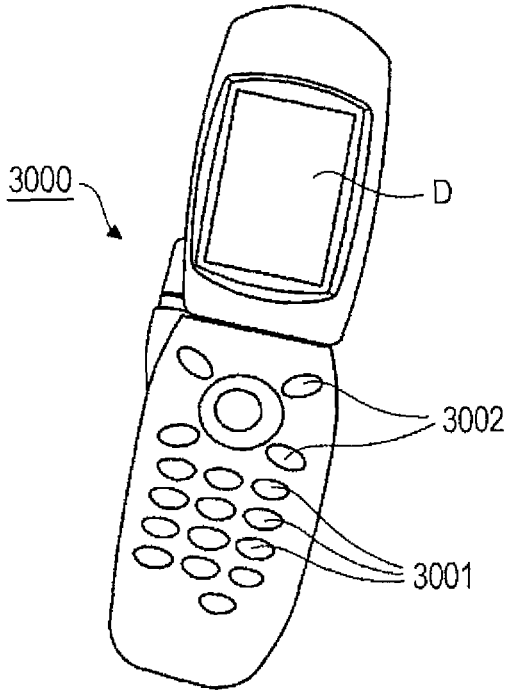
FIG. 16 is a perspective view of another electronic apparatus (mobile phone) to which the invention is applied.
Figure 17:
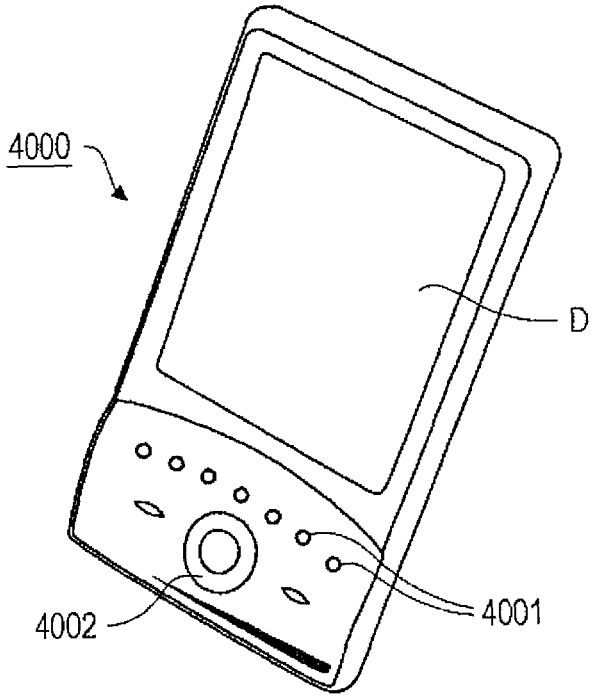
FIG. 17 is a perspective view of another electronic apparatus (personal digital assistant) to which the invention is applied.
Figure 18:
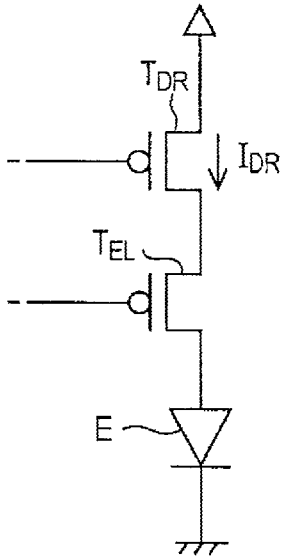
FIG. 18 is a circuit diagram of an arrangement for driving a light emitting element.

Electronic apparatuses related to the invention will now be described. FIGS. 15 to 17 illustrate electronic apparatuses each including the above-described light emitting device D as a display unit.

FIG. 15 is a perspective view of a mobile personal computer including the light emitting device D. A personal computer 2000 includes the light emitting device D for image display and a main body 2010 provided with a power supply switch 2001 and a keyboard 2002. The light emitting device D enables clear image display with a wide viewing angle because the light emitting device D includes organic light-emitting diodes as the light emitting elements E.

FIG. 16 is a perspective view of a mobile phone including the light emitting device D. A mobile phone 3000 includes a plurality of operation buttons 3001, scroll buttons 3002, and the light emitting device D for image display. Operating the scroll buttons 3002 scrolls images displayed on the light emitting device D.

FIG. 17 is a perspective view of a personal digital assistant (PDA) including the light emitting device D. A PDA 4000 includes a plurality of operation buttons 4001, a power supply switch 4002, and the light emitting device D for image display. Operating the power supply switch 4002 allows for display of various pieces of information, such as an address list and a schedule book, on the light emitting device D.

Electronic apparatuses, each including the light emitting device of the invention, include a digital still camera, a television, a video camera, a car navigation system, a pager, an electronic organizer, an electronic paper, an electronic calculator, a word processor, a workstation, a video phone, a POS terminal, a printer, a scanner, a copy machine, a video player, and an apparatus having a touch panel in addition to the apparatuses shown in FIGS. 15 to 17. Applications of the light emitting device of the invention are not limited to apparatuses for image display. For example, an electrophotographic image forming apparatus uses an exposure unit (line head) for exposing a photosensitive member in accordance with an image to be formed on a recording member, such as a sheet of paper. The light emitting device of the invention may also be used as this type of exposure device.

The entire disclosure of Japanese Patent Application No. 2006-183054, filed Jul. 3, 2006 is expressly incorporated by reference herein.

What is claimed is:

1. A method of driving a light emitting device including a first power supply line, a second power supply line, a first transistor that is P-channel type, a driving transistor that controls a driving current flowing between the first power supply line and the first transistor and that is P-channel type, a light emitting element having a first electrode coupled to the first transistor and a second electrode coupled to the second power supply line, a capacitor having a first end coupled to a first gate of the driving transistor and a second end, and a second transistor coupled between the second end of the capacitor and a data line, the method comprising:

setting a first gate potential of the driving transistor through the second transistor and the data line by turning the second transistor on and turning the first transistor off during a writing period, supplying the driving current through the first transistor to the light emitting element for a light emitting period during which the light emitting element is allowed to emit light, when let $-V_{EL}(-V_{EL}<0)$ be a second potential of the second power supply line with reference to a first potential of the first power supply line, let $V_{EL_MAX}(V_{EL_MAX}<0)$ be a maximum voltage drop of the light emitting element, let $V_{T2}(V_{T2}<0)$ be a first threshold voltage of the first transistor, and let $V_{G_ON}$ be a second gate potential of the first transistor, the second gate potential of the first transistor for the light emitting period is set so as to satisfy the following relation:

$$V_{G_ON}>-V_{EL}-V_{EL_MAX}+V_{T2}.$$

2. The method according to claim 1, wherein when let $V_{DATA_MAX}$ $(V_{DATA_MAX}<0)$ be a gate-source voltage of the driving transistor of which the driving current reaches its maximum value and let $V_{T1}(V_{T1}<0)$ be a second threshold voltage of the driving transistor, the second gate potential of the first transistor for the light emitting period is set so as to satisfy the following relation:

$$V_{G_ON}<V_{DATA_MAX}-V_{T1}+V_{T2}.$$

3. The method according to claim 1, wherein the first transistor and the second transistor have the same conductivity type and the same size.

4. The method according to claim 3, wherein the same potential as that at which the first transistor is turned on for the light emitting period is supplied to a gate of the second transistor for the writing period.

5. The light emitting device according to claim 4, wherein when let $V_{DATA_MAX}$ $(V_{DATA_MAX}<0)$ be a gate-source voltage of the driving transistor of which the driving current reaches its maximum value and let $V_{T1}$ $(V_{T1}<0)$ be a second threshold voltage of the driving transistor, the second gate potential of the first transistor for the light emitting period is set so as to satisfy the following relation:

$$V_{G_ON}<V_{DATA_MAX}-V_{T1}+V_{T2}.$$

6. The light emitting device according to claim 4, wherein the first transistor and the second transistor have the same conductivity type and the same size.

7. The method according to claim 6, wherein the same potential as that at which the first transistor is turned on for the light emitting period is supplied to a gate of the second transistor for the writing period.

8. A light emitting device comprising:

a first power supply line;

a second power supply line;

a first transistor that is P-channel type;

a driving transistor that controls a driving current flowing between the first power supply line and the first transistor and that is P-channel type;

a light emitting element having a first electrode coupled to the first transistor and a second electrode coupled to the second power supply line;

a capacitor having a first end coupled to a first gate of the driving transistor and a second end;

a second transistor coupled between the second end of the capacitor and a data line; and a circuit that turns the second transistor on and that turns the first transistor off during a writing period, the circuit setting a first gate potential to a first gate of the first transistor for a light emitting period during which the light emitting element is allowed to emit light, when let $-V_{EL}$ $(-V_{EL}<0)$ be a second potential of the second power supply line with reference to a first potential of the first power supply line, let $V_{EL_MAX}(V_{EL_MAX}<0)$ be a maximum voltage drop of the light emitting element, let VT2 $(V_{T2}<0)$ be a first threshold voltage of the first transistor, and let $V_{G_ON}$ be the first gate potential, the first gate potential for the light emitting period is set so as to satisfy the following relation:

$$V_{G\text{-}ON}>-V_{EL}-V_{EL_MAX}+V_{T2}.$$

* * * * *